US005244150A

United States Patent [19]

Ricco et al.

[11] Patent Number: 5,244,150

[45] Date of Patent: Sep. 14, 1993

[54] HIGH PRESSURE PLUNGER SYSTEM FOR THE CONTROL VALVE OF AN ELECTROMAGNETIC INTERNAL COMBUSTION ENGINE FUEL INJECTOR

[75] Inventors: Mario Ricco, Bari; Sisto L. De Matthaeis, Modugno, both of Italy

[73] Assignee: Elasis Sistema Ricerca Fiat Nel Mezzogiorno Societa, Pomigliano D'Arco, Italy

[21] Appl. No.: 783,417

[22] Filed: Oct. 28, 1991

[30] Foreign Application Priority Data

Oct. 31, 1990 [IT] Italy ..... 53352/90[U]

[51] Int. Cl.[5] ..... F02M 47/06; F02M 51/06; F02M 63/04

[52] U.S. Cl. ..... 239/96; 239/533.8; 239/533.9; 239/585.3

[58] Field of Search ..... 239/88, 96, 533.8, 533.9, 239/533.11, 585.1, 585.3; 251/129.18

[56] References Cited

U.S. PATENT DOCUMENTS 4,218,021 8/1980 Palma ..... 239/585.2
4,365,747 12/1982 Knapp et al. ..... 239/585.3 X
4,709,679 12/1987 Djordjevic et al. ..... 239/585.1 X
4,946,103 8/1990 Ganser ..... 239/585.3 X
4,972,997 11/1990 Filippi ..... 239/585.1
4,993,636 2/1991 Taue et al. ..... 239/533.8 X
5,044,563 9/1991 Mesenich ..... 251/129.18 X
5,048,756 9/1991 Bonfigilioli et al. ..... 239/585.3 X

FOREIGN PATENT DOCUMENTS 0196265 10/1986 European Pat. Off. .
2182756A 5/1987 United Kingdom .

*Primary Examiner*—Andres Kashnikow
*Assistant Examiner*—William Grant
*Attorney, Agent, or Firm*—Baker & Daniels

[57] ABSTRACT

The control valve of an injector comprises a plunger and a valve body having an axial control chamber connected to a drain conduit via a hole. The hole terminates at a flat surface of the valve body, which surface is perpendicular to the operating direction of the actuator of the plunger. The plunger consists of a pad element having a flat face engaging the surface of the valve body, while the opposite face may be flat or spherical, and is engaged by a complementary surface on the end of the actuator.

9 Claims, 3 Drawing Sheets

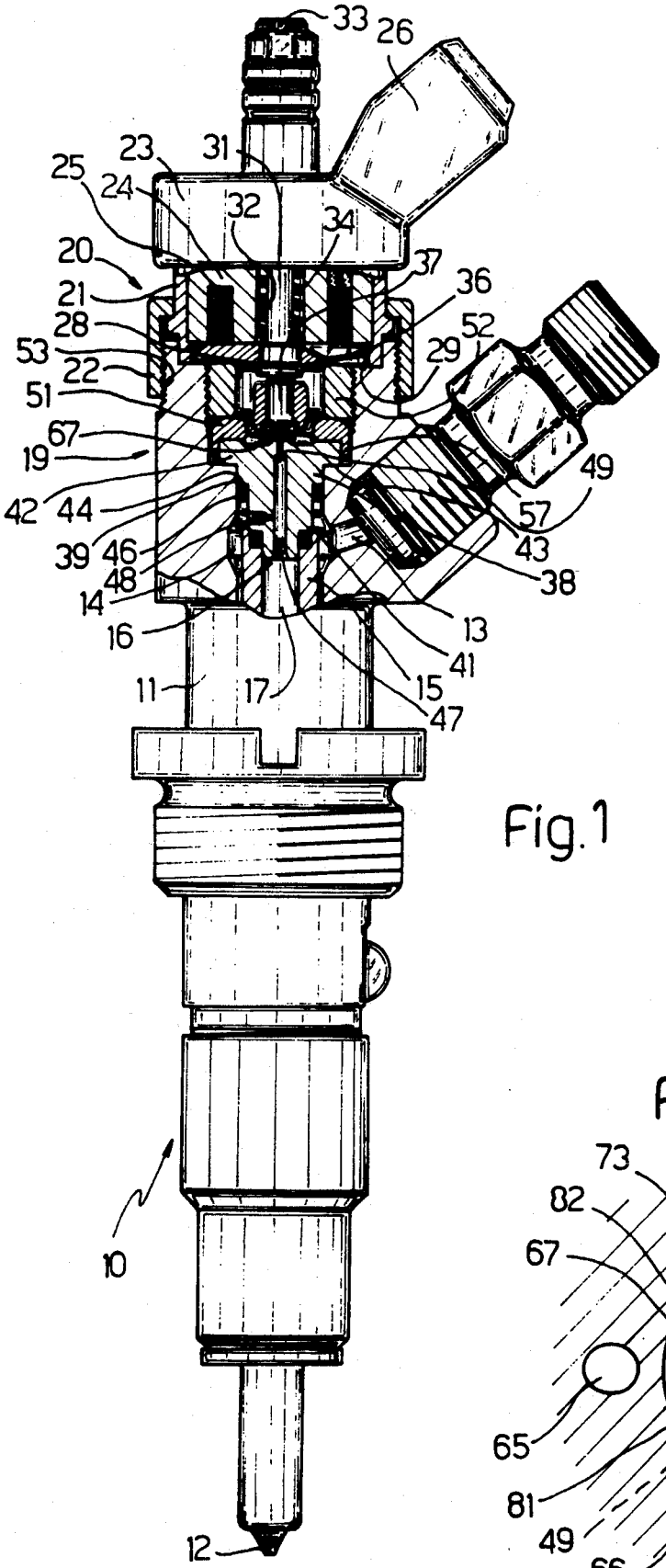
Fig. 1
Fig. 6
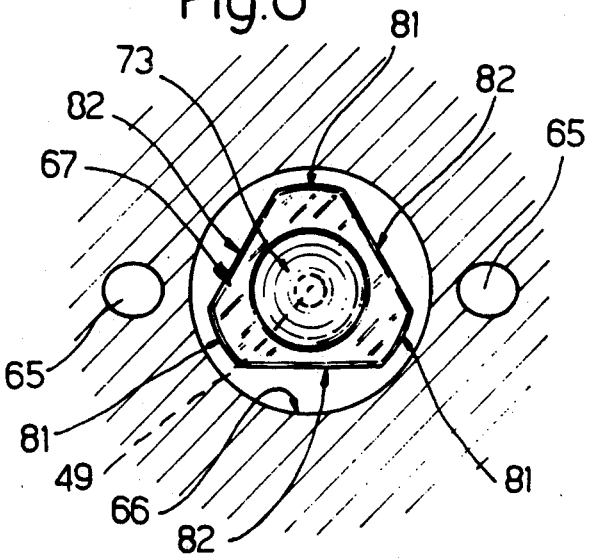

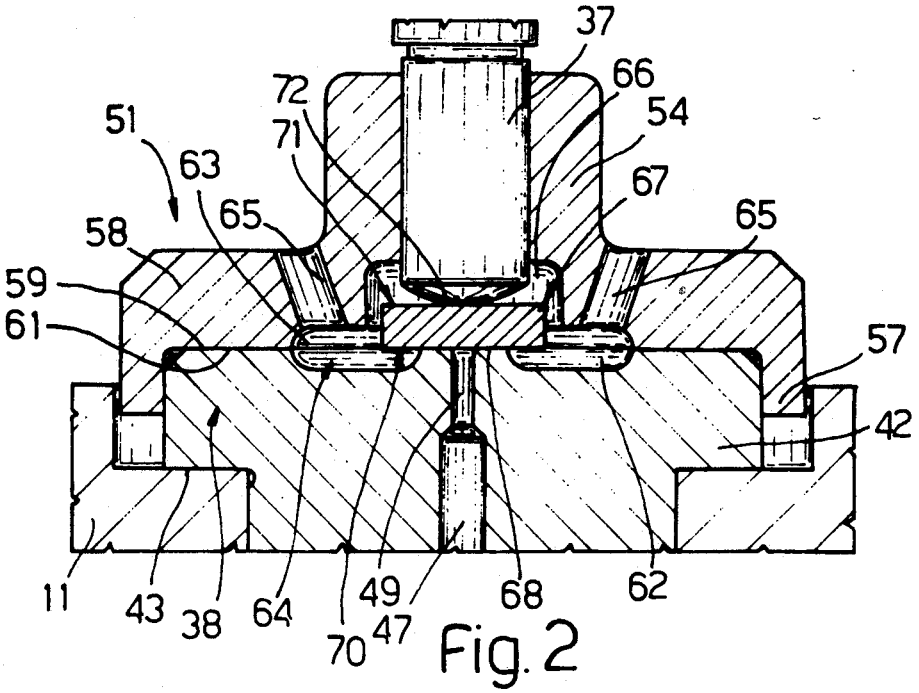
Fig. 2
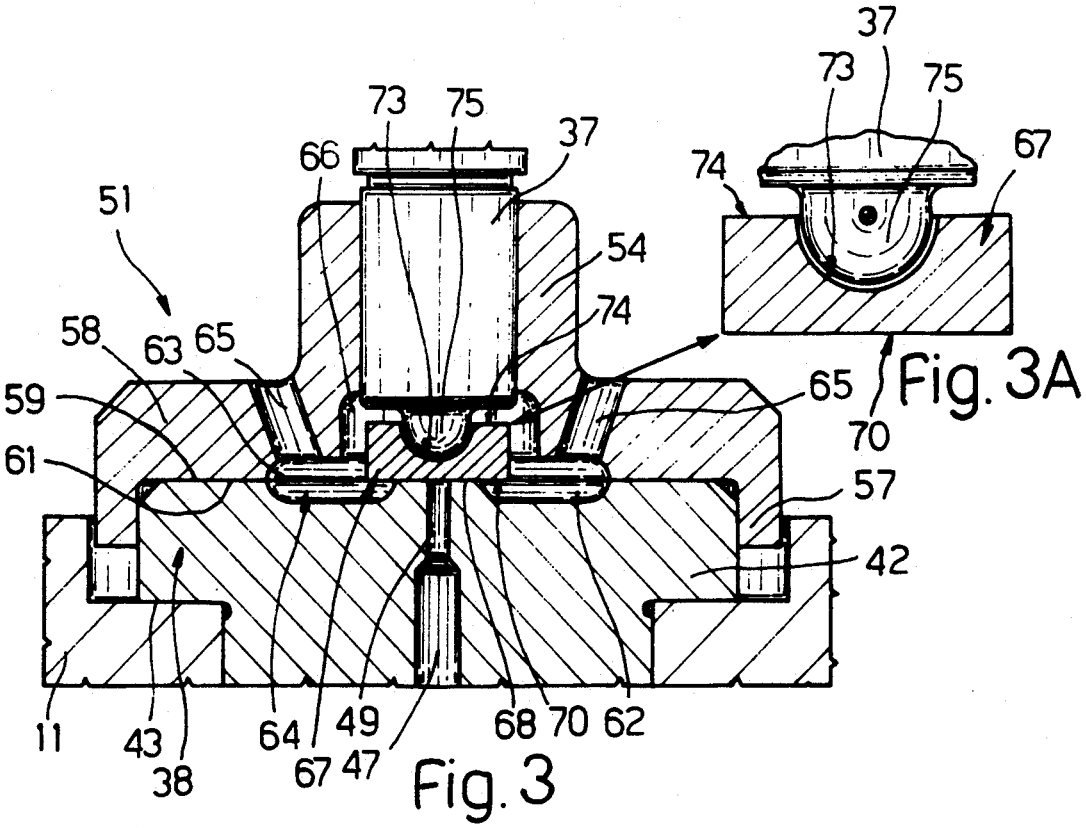
Fig. 3A
Fig. 3

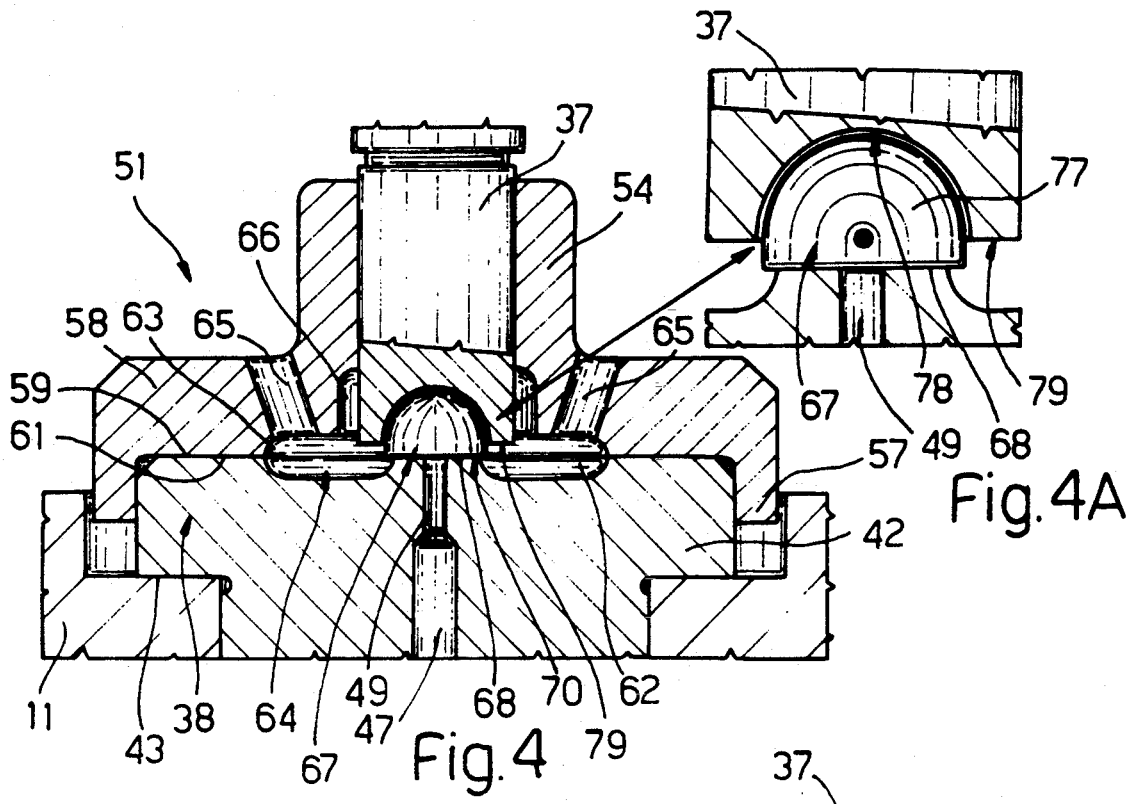
Fig. 4A
Fig. 4
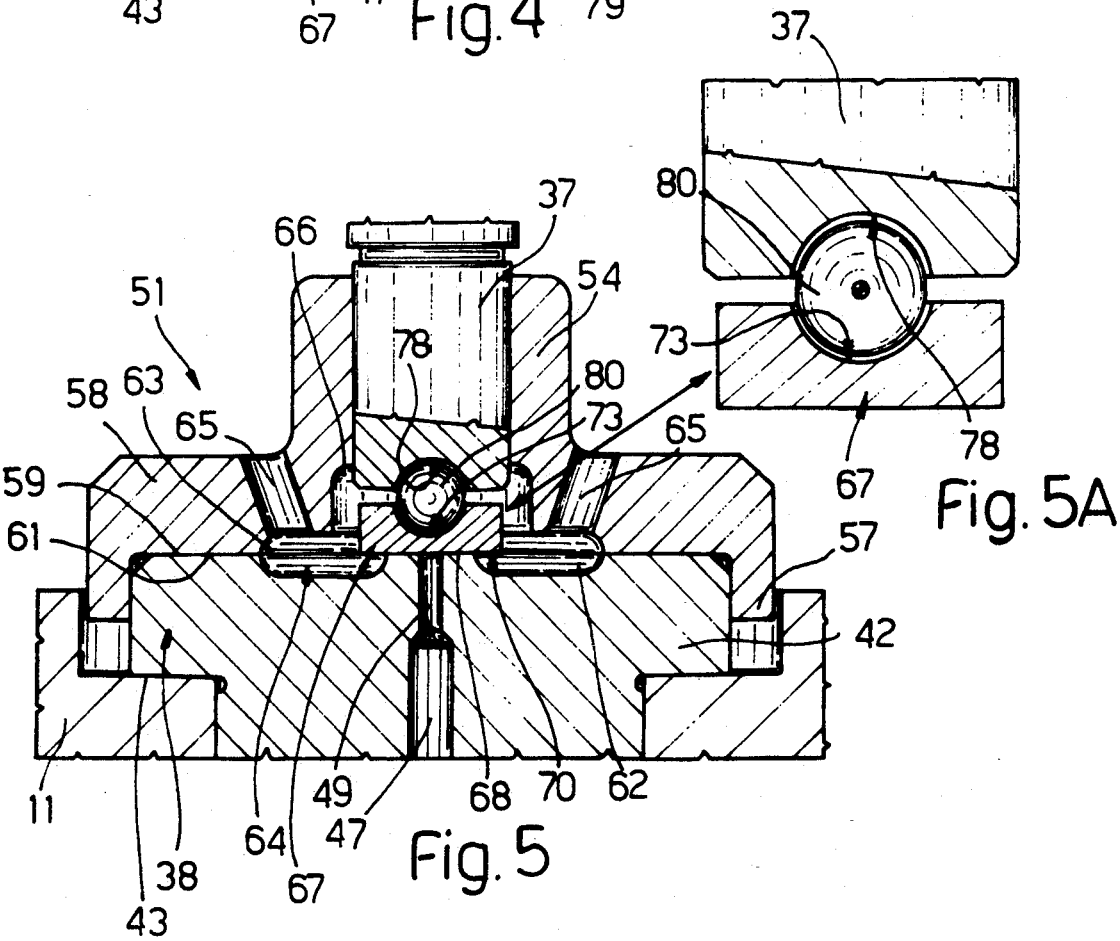
Fig. 5A
Fig. 5

HIGH PRESSURE PLUNGER SYSTEM FOR THE CONTROL VALVE OF AN ELECTROMAGNETIC INTERNAL COMBUSTION ENGINE FUEL INJECTOR

BACKGROUND OF THE INVENTION

The present invention relates to an electromagnetic injector or internal combustion engine fuel injection systems.

Injectors of the aforementioned type normally comprise a body with a nozzle which, for injecting fuel, is opened by a control valve which connects the control chamber of the nozzle to a drain conduit. The nozzle is normally closed by a plunger and the fuel pressure inside the control chamber, and is opened by the control valve reducing the pressure inside the chamber and raising the plunger.

The control valve on known injectors normally comprises a ball cooperating with a conical seat in a hole connecting the control chamber to the drain conduit. Control valves of the aforementioned type present numerous drawbacks. Firstly, contact between he ball and the conical seat occurs entirely about a circumference, so that, to ensure sealing between the two, both the ball and seat must be machined to a high degree of precision, which obviously increases the cost of the injector. Secondly, due to the severe pressure involved, such a connection is invariably subject to a certain amount of leakage on account of the shallow contact surface between the ball and the conical surface.

Finally, due to wear, the ball tends to rut the conical surface, forming an impression or recess, which results in a variation of the surface of the ball exposed to the fuel pressure and, consequently, in the thrust of the ball in the direction of the return spring, thus impairing operation of the injector.

SUMMARY OF THE INVENTION

It is an object of the present invention to provide an electromagnetic injector featuring a straightforward control valve designed to overcome the above drawbacks typically associated with known injectors.

According to the present invention, there is provided an electromagnetic injector comprising a hollow body with a normally-closed nozzle which is opened for injecting fuel into the engine; a member fitted inside said hollow body and having a control chamber; and a control valve comprising a hole connecting said chamber to a drain conduit, and a plunger controlled by the armature of an electromagnet for opening said nozzle; said chamber normally communicating with the pressurized fuel; characterised by the fact that said hole terminates at a flat surface of said member; said plunger consisting of a pad element having a flat face mating with said surface; said anchor presenting an actuator for engaging the opposite face of said pad element via displacement substantially perpendicular to said surface.

BRIEF DESCRIPTION OF THE DRAWINGS

A number of preferred non-limiting embodiments of the present invention will be described by way of example with reference to the accompanying drawings, in which:

FIG. 1 shows a partially sectioned view of a first embodiment of the electromagnetic injector according to the present invention;

FIG. 2 shows a larger-scale section of the control valve on the FIG. 1 injector;

FIGS. 3 and 3A show a section of the control valve on a further embodiment of the injector according to the present invention;

FIGS. 4 and 4A show a section of the control valve on a further embodiment of the injector according to the present invention;

FIGS. 5 and 5A show a section of the control valve on a fourth embodiment of the injector according to the present invention;

FIG. 6 shows a larger-scale plan view of a variation of a detail in FIGS. 3 and 5.

DETAILED DESCRIPTION OF THE INVENTION

Number 10 in FIG. 1 indicates an internal combustion engine fuel injector comprising a tapered hollow body 11 filter at the bottom with an injection nozzle 12 communicating with a normal high pressure (e.g. 1500 bar) chamber not shown.

In known manner, the high pressure chamber is supplied by a pressurized fuel input conduit 13 via an annular chamber 14 and an inner conduit not shown. From conduit 13, the fuel is supplied by a high pressure (e.g. 1500 bar) pump.

Body 11 is fitted inside with a bush 15 having a cylindrical axial cavity 16 housing an axially-sliding rod 17 pushed own by a coaxial spiral spring. Rod 17 extends downwards and terminates at the bottom in a tip designed to engage a seat inside nozzle 12 of which it therefore acts as the plunger.

Rod 17 is controlled by a valve 19 in turn controlled by an electromagnet 20 on a bush 21 secured to body 11 by ring nut 22. Bush 21 is fitted with a cap 23 closing the top of body 11.

Electromagnet 20 comprises a magnetic core 24 housing an electric coil 25 supplied by an electric connection on appendix 26 of cap 23. Electromagnet 20 also comprises a magnetic armature in the form of a disc 28 housed inside a cylindrical portion 29 of the inner wall of bush 21. Disc 28 is fitted to a rod 31 inserted inside an axial hole 32 in core 24. Hole 32 communicates in known manner with a fuel drain conduit 33 through cap 23 and connected to the fuel tank.

Hole 32 also houses a helical compression spring for pushing disc 28 downwards. Disc 28 presents a radial opening 36 communicating with axial hole 32, and is integral at the bottom with an actuator for control valve 19, consisting of a stem 37.

Control valve 19 comprises a substantially cylindrical valve member or body 38 housed in a compartment 39 extending upwards of annular chamber 14. Body 38 resents, at the bottom, a shoulder 41 sealed inside a seat on the op end of bush 15.

At the top, body 38 presents a flange 42 resting on a shoulder 43 of body 11. A second shoulder 44 on body 38 houses a seal 46 for upwardly sealing annular chamber 14.

Body 38 presents a coaxial, cylindrical control chamber 47 communicating at the bottom with cavity 16; with annular chamber 14 via radial hole 48, for receiving pressurized fuel from conduit 13; and externally at the top via a calibrated axial hole 49.

Flange 42 of body 38 is integral with a bell-shaped member 51 secured to hollow body 11 by a threaded ring nut 52 screwed inside a threaded seat 53 (FIG. 2) on body 11. Member 51 comprises a sleeve 54 forming an annular chamber 56 with the inner surface of ring nut 52. The inner surface of sleeve 54 acts as a precision guide for actuator 37 of valve 19.

Bell-shaped member 51 also comprises a ring 57 surrounding flange 42 of body 38 so that member 51 keeps sleeve 54 centered in relation to body 38. Finally, member 51 comprises a flange 58 having a flat annular portion 59 engaging, by means of ring nut 52, a flat annular portion 61 of flange 42.

The upper surface of flange 42 comprises a depression 62 forming an annular chamber 64 with a matching depression 63 on flange 58. Annular chamber 64 communicates with annular chamber 56 via two or more inclined holes 65 through flange 58. A further central depression 66 on flange 58 houses the plunger 67 of valve 19, which is controlled by stem 37 for opening and closing hole 49. The injector according to the present invention operates as follows.

Electromagnet 20 is normally de-energized, in which case, disc 28 is detached from core 24 by spring 34 (FIG. 1); plunger 67 is held down by stem 37 so as to close hole 49; and, via cavity 16, the fuel pressure in control chamber 47 combines with the respective spring for forcing rod 17 downwards with its bottom end closing nozzle 12.

When electromagnet 20 is energized, disc 28 moves up, thus causing stem 37 to release plunger 67, which is raised by the fuel pressure in chamber 47; and fuel flows through hole 49 into annular chamber 64 (FIG. 2), and through inclined holes 65 into annular chamber 53 and towards drain conduit 33.

The fall in pressure inside control chamber 47 and the fuel pressure inside the pressure chamber then raise rod 17, thus opening nozzle 12 for injecting fuel into the engine cylinder.

When electromagnet 20 is de-energized, spring 34 pushes down disc 28; stem 37 restores plunger 67 to the closed position over hole 49; control chamber 47 is again pressurized; and rod 17 moves back down to close nozzle 12.

Operation of control valve 19 is notedly delicate both in terms of timing and response; the travel of armature 28 and, consequently, plunger 67 is extremely small, measurable in tenths of a millimeter; and sealing between plunger 67 and hole 49 invariably poses problems.

According to one characteristic of the present invention, hole 49 terminates at a perfectly flat surface 68 of flange 42 (FIGS. 2–5), which surface 68 is also perpendicular to the axis of sleeve 58 and stem 37, and therefore perpendicular to the travel direction of stem 37. Plunger 67 in turn consists of a pad element, the lower face 70 of which presents a perfectly flat surface mating in sealed manner with surface 68 of flange 42.

Pad element 67 may be round in shape and slightly smaller in diameter than depression 66, so as to move with a certain amount of freedom inside depression 66. The upper face of element 67 is engaged by the bottom end surface of stem 37, which surface is generally spherical, so that the action exerted on element 67 is directed perpendicular to surface 68 of flange 42.

In the FIG. 1 and 2 embodiment, element 67 is in the form of a plate, the upper face 71 of which also presents a flat surface. The lower surface of stem 37 in turn consists of a spherical tip 72 acting on the surface of face 71, thus drastically reducing the manufacturing cost of valve 19 and stem 37.

In the FIG. 3 embodiment, element 67 is again in the form of a plate, the upper face of which is flat and concave, consisting of a spherical hollow portion 73 and a flat annular portion 74. Preferably, hollow 73 consists substantially of a half sphere.

The lower surface of stem 37, on the other hand, is flat and convex, and comprises a spherical cap-shaped portion 75 slightly smaller in diameter than hollow 73, and a flat ring 76. The combined action of portion 75 and hollow 73 therefore provides for centering plate 67 in relation to hole 49.

In the FIG. 4 embodiment, pad element 67 presents a flat lower ace 68 and an upper face in the form of a spherical cap 77. Preferably, element 67 substantially consists of a sphere faceted on surface 68, so as to produce a cap 77 consisting of at least a half sphere, i.e. so that element 67 includes the diametrical plane of the sphere, parallel to surface 68.

The lower surface of stem 37, on the other hand, is flat and concave, and comprises a spherical hollow portion 78 slightly smaller in diameter than cap 77, and a ring 79. In this case also, the combined action of hollow 78 and cap 77 provides for centering element 67 in relation to hole 49, plus the added advantage of hollow 78 of stem 37 acting on the thickest part of element 67.

In the FIG. 5 embodiment, the plunger of valve 19 consists of a flat-concave plate 67 comprising a spherical hollow portion 73 similar to that of FIG. 3. The lower surface of stem 37 is also flat and concave, and comprises a spherical hollow portion 78, similar to that of FIG. 4. Between hollows 73 and 78, there is inserted a ball 80 for adapting and centering the action of stem 37 on plate 67.

Pad element 67 may be round, as already stated, or faceted to substantially produce a polygon having alternating round portions 81 (FIG. 6) and flat portions 82. Such a design may advantageously present three identical flat portions 82 with three identical alternating round portions 81 as shown in FIG. 6, which shows the flat-concave plate 67 of FIGS. 3 and 5. Plate 67 in FIG. 2 and element 67 in FIG. 4 may also be similarly faceted.

The advantages of the present invention will be clear from the foregoing description. In particular, precision machining of flat surfaces 68 and 70 is far more economical than he spherical surface machining required by known injectors. Similar saving is also possible as regards the spherical surfaces of plunger 67 and stem 37, which no longer provide for sealing.

Moreover, contacting flat surfaces 68 and 70 are no longer subject to rutting, due to wear, or fuel leakage, by virtue of the increased sealing and contact surfaces over which the fuel is forced to travel.

To those skilled in the art it will be clear that changes may be made to the injector as described and illustrated herein without, however, departing from the scope of the present invention. For example, electromagnet 20 and valve body 38 may be fitted differently to body 11 of injector 10.

We claim:

1. An electromagnetic internal combustion engine fuel injector comprising:

a hollow body (11) provided with a normally-closed nozzle (12) adapted to be opened for injecting fuel into the engine;

a valve body (38) fitted inside said hollow body (11) and having a control chamber (47) normally communicating with the pressurized fuel; and a control valve comprising a hole (49) connecting said chamber (47) to a drain conduit (33), and a plunger (67) controlled by the armature (28) of an electromagnet (20) for opening said nozzle (12);

said valve body (38) being sealed inside said hollow body (11) by means of a threaded ring nut (52) and a bell-shaped member (51);

said hole (49) terminating at a flat surface (68) of said valve body (38), said plunger being formed of a pad element (67) having a flat face (70) mating with said surface (68);

said armature (28) being integral with a stem (37) having a spherical free end (72);

said armature (28) and said stem (37) being displaced substantially perpendicular to said surface (68) to engage said free end (72) with the opposite face (71, 73, 77) of said pad element (67).

2. An injector as claimed in claim 1, wherein said stem (37) is guided by a sleeve (54) on said bell-shaped member (51); said pad element (67) moving inside a seat (66) formed in said bell-shaped member (51).

3. An injector as claimed in claim 1, wherein said opposite face (71) is also flat, and is engaged by a spherical-cap-shaped surface (72) on said free end.

4. An injector as claimed in claim 1, wherein said pad element (67) is movable in a central depression (66) of said bell-shaped member (51), said pad element being substantially polygonal, and comprised of a series of alternating flat portions (82) and round portions (81).

5. An electromagnetic internal combustion engine fuel injector comprising:

a hollow body (11) provided with a normally-closed nozzle (12) adapted to be opened for injecting fuel into the engine;

a member (38) fitted inside said hollow body (11) and having a control chamber (47) normally communicating with the pressurized fuel; and a control valve comprising a hole (49) connecting said chamber (47) to a drain conduit (33), and a plunger (67) controlled by the armature (28) of an electromagnet (20) for opening said nozzle (12);

said hole (49) terminating at a flat surface (68) of said member (38), said plunger being formed of a pad element (67) having a flat face (70) mating with said surface (68);

said armature (28) being integral with an elongated stem (37) having a free end (72);

said armature (28) and said stem (37) being displaced substantially perpendicular to said surface (68) to engage said free end (72) with the opposite face (71, 73, 77) of said pad element (67); said free end (72) having a flat portion and a convex portion such that a cap-shaped surface (75) is formed;

said opposite face (73) including a concave surface with a radius slightly larger than that of the convex portion of said cap-shaped surface (75).

6. An electromagnetic internal combustion engine fuel injector comprising:

a hollow body (11) provided with a normally-closed nozzle (12) adapted to be opened for injecting fuel into the engine;

a member (38) fitted inside said hollow body (11) and having a control chamber (47) normally communicating with the pressurized fuel; and a control valve comprising a hole (49) connecting said chamber (47) to a drain conduit (33), and a plunger (67) controlled by the armature (28) of an electromagnet (20) for opening said nozzle (12);

said hole (49) terminating at a flat surface (68) of said member (38), said plunger being formed of a pad element (67) having a flat face (70) mating with said surface (68);

said armature (28) being integral with a stem (37) having a free end (72);

said armature (28) and said stem (37) being displaced substantially perpendicular to said surface (68) to engage said free end (72) with the opposite face (71, 73, 77) of said pad element (67);

said pad element (67) consisting of a spherical cap (77) formed by faceting a sphere to produce said flat face (68);

said free end (72) having a concave spherical surface (78) engaging said spherical cap (77).

7. An injector as claimed in claim 6, wherein said spherical cap (77) consists of a sphere portion at least equal to half of the sphere.

8. An electromagnetic internal combustion engine fuel injector comprising:

a hollow body (11) provided with a normally-closed nozzle (12) adapted to be opened for injecting fuel into the engine;

a member (38) fitted inside said hollow body (11) and having a control chamber (47) normally communicating with the pressurized fuel; and a control valve comprising a hole (49) connecting said chamber (47) to a drain conduit (33), and a plunger (67) controlled by the armature (28) of an electromagnet (20) for opening said nozzle (12);

said hole (49) terminating at a flat surface (68) of said member (38), said plunger being formed of a pad element (67) having a flat face (70) mating with said surface (68);

said armature (28) being integral with a stem (37) having a free end (72);

said armature (28) and said stem (37) being displaced substantially perpendicular to said surface (68) to engage said free end (72) with the opposite face (73) of said pad element (67);

the surface of said opposite face (73) and the surface (78) of said stem (37) each including a flat portion and a concave portion to form a flat-concave surface;

a ball (80) being inserted between the concave portions of said two flat-concave surfaces (73, 78).

9. An injector as claimed in claim 8, wherein each flat-concave surface (73, 78) comprises a spherical portion slightly larger in diameter than said ball (80).

* * * * *

UNITED STATES PATENT AND TRADEMARK OFFICE

CERTIFICATE OF CORRECTION

PATENT NO. : 5,244,150

DATED : September 14, 1993

INVENTOR(S) : Mario Ricco et al

It is certified that error appears in the above-identified patent and that said Letters Patent is hereby corrected as shown below:

Title Page:

Item [73] "Assignee", change the Assignee from "Elasis Sistema Ricerca Fiat Nel Mezzogiorno Societa to

--ELASIS SISTEMA RICERCA FIAT NEL MEZZOGIORNO SOCIETA CONSORTILE PER AZIONI--.

Signed and Sealed this

Eleventh Day of July, 1995

*Attest:*

BRUCE LEHMAN

*Attesting Officer*

*Commissioner of Patents and Trademarks*